US007747194B2

(12) United States Patent
Takuwa

(10) Patent No.: US 7,747,194 B2
(45) **Date of Patent: *Jun. 29, 2010**

(54) TONER SUPPLY DEVICE AND IMAGE FORMING APPARATUS

(75) Inventor: Noriyuki Takuwa, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/203,548

(22) Filed: Sep. 3, 2008

(65) Prior Publication Data

US 2009/0003886 A1 Jan. 1, 2009

Related U.S. Application Data

(60) Continuation of application No. 11/822,072, filed on Jul. 2, 2007, now Pat. No. 7,428,399, which is a division of application No. 10/862,470, filed on Jun. 8, 2004, now Pat. No. 7,245,852.

(30) Foreign Application Priority Data

Jul. 8, 2003 (JP) ..... 2003-193814
Jul. 8, 2003 (JP) ..... 2003-193869

(51) Int. Cl.
*G03G 15/08* (2006.01)

(52) U.S. Cl. ..... 399/120; 399/262

(58) Field of Classification Search ..... 399/30, 399/58, 61, 119, 120, 258, 262
See application file for complete search history.

(56) References Cited

U.S. PATENT DOCUMENTS

| | | | | |
|---|---|---|---|---|
| 5,774,773 | A | 6/1998 | Otsuka et al. | |
| 5,907,756 | A | 5/1999 | Shirota et al. | |
| 6,256,470 | B1 | 7/2001 | Taniyama et al. | |
| 6,363,235 | B1 | 3/2002 | Chiesa et al. | |
| 6,421,518 | B1 | 7/2002 | Floyd et al. | |
| 7,245,852 | B2 * | 7/2007 | Takuwa | 399/120 |
| 2004/0223790 | A1 | 11/2004 | Hosokawa et al. | |

FOREIGN PATENT DOCUMENTS

| | | |
|---|---|---|
| JP | 2-186373 A | 7/1990 |
| JP | 6-214461 A | 8/1994 |
| JP | 10-48935 A | 2/1998 |

* cited by examiner

*Primary Examiner*—David M Gray
*Assistant Examiner*—Joseph S Wong
(74) *Attorney, Agent, or Firm*—Foley & Lardner LLP

(57) ABSTRACT

A toner supply device is equipped with a coupling that has a toner supply opening on the side wall, a partition wall provided in this coupling integrally with a specific space provided on the inner wall and a hole larger than a toner supply opening on the side wall. A toner bottle containing toner is provided in the coupling with its cap portion inserted airtight into the partition wall detachably and an opening provided on its cap portion opposing to the hole on the partition wall for replenishing toner to a developing device from this opening through the hole and a toner supply opening.

10 Claims, 12 Drawing Sheets

TONER SUPPLY DEVICE AND IMAGE FORMING APPARATUS

CROSS-REFERENCE TO RELATED APPLICATIONS

This application is based upon and a Continuation of U.S. application Ser. No. 11/822,072, filed Jul. 2, 2007, which is a Division of U.S. application Ser. No. 10/862,470, filed Jun. 8, 2004, which claims the benefit of priority from the prior Japanese Patent Application No. 2003-193869, filed on Jul. 8, 2003 and Japanese Patent Application No. 2003-193814, filed on Jul. 8, 2003; the entire contents of which are incorporated herein by reference.

BACKGROUND OF THE INVENTION

1. Field of the Invention

This invention relates to a toner supply device and an image forming apparatus that are used in, for example, electrophotographic copiers.

2. Description of the Related Art

An image forming apparatus forms an electrostatic latent image on a photosensitive drum that is an image carrier and develops this electrostatic latent image with a developing device. A toner bottle that is a toner supply device is attached to the developing device and toners are supplied to the developing device.

A cap portion of the toner bottle is inserted into a coupling that forms a driving unit and connected to the coupling. An opening is provided on a peripheral wall of the cap portion and a toner supply opening is provided on a peripheral wall of the coupling. When the cap portion of the toner bottle is inserted into the coupling, its opening is opposed to the toner supply opening of the coupling.

When supplying a toner, the toner bottle is rotated with the rotation of the coupling and when the opening of the toner bottle and the toner supply opening is located at the lower side, a toner in the toner bottle falls by its own weight through the opening and is supplied in the developing device.

As the cap portion of the toner bottle is inserted in the coupling and fitted in the airtight state, when the toner bottle is pulled out, the pressure in the coupling changes rapidly, However, as a hole provided so far to the coupling was only at the toner supply opening. A strong sucking power acts on the toner supply opening. Therefore, there was such a problem that toner adhered to the peripheral edge portion of the toner supply opening is sucked into the toner bottle and the inside of the coupling is contaminated.

Further, when some defect was generated and the rotation of the toner bottle was stopped during the image forming operation, operator may pull out the toner bottle erroneously at a position other than the specific position.

However, when the toner bottle was pulled out at a position other than the specific position, the coupling was so far kept in the stopped state at that position. Therefore, there was such a trouble that a time was needed to position a toner bottle against the coupling and the toner bottle could not be inserted smoothly into the coupling when reinserting the toner bottle.

Further, there are couplings that can be rotated irrespective of the presence of a toner bottle. In this case, however, there was such a problem that if the coupling was erroneously rotated without inserting a toner bottle into the coupling, a toner flows back from the toner supply opening of the coupling and is scattered by centrifugal force.

SUMMARY OF THE INVENTION

An object of this invention is to provide a toner supply device that does not suck a toner from the toner supply opening of the coupling and an image forming apparatus.

Another object of this invention is to provide a toner supply device which rotates a coupling when a toner bottle is pulled out from the coupling at a position other than a specific position and disconnects the coupling from a driving unit when a toner bottle is not inserted into the coupling and an image forming apparatus.

According to this invention, there is provided a toner supply device comprising: a coupling that has a toner supply opening on a peripheral wall portion; a partition wall that is provided integrally with a specified space along an inner wall of the coupling and has a hole in an opening larger than the toner supply opening on the peripheral wall portion; and a toner bottle containing toner with a cap portion inserted airtight into the partition wall, having a toner replenishing opening opposite to the hole on the cap peripheral wall and supply the toner to a toner supply portion through the holes and the toner supply opening from the toner replenishing opening.

Further, according to this invention, there is provided an image forming apparatus comprising: an image forming unit to form an electrostatic latent image on an image carrier; a developing unit to form a toner image by supplying a toner to the electrostatic latent image formed by the image forming unit; and a toner supply device to replenish the toner to the developing unit, wherein the toner supply device includes: a coupling that has a toner supply opening on a peripheral wall portion; a partition wall that is provided integrally with a specified space and has holes larger than the toner supply opening on the peripheral wall portion; and a toner bottle containing toner with a cap portion inserted airtight into the partition wall, having a toner replenishing opening opposite to the hole on the cap peripheral wall and supply the toner to a toner supply portion through the holes and the toner supply opening from the toner replenishing opening.

In addition, according to this invention, there is provided a toner replenishing device comprising: a toner bottle containing a toner; a coupling to insert a cap portion side of the toner bottle at a specific position and connect it in the removable state; and a driving unit to rotate the coupling and replenish the toner to a developing device requiring the replenishing of toner from the cap portion by rotating the toner bottle and rotate the coupling to the specific position when the toner bottle is pulled out at a position other than the specific position.

Further, according to this invention, there is provided an image forming apparatus comprising: an image forming portion to form an electrostatic latent image on an image carrier; a developing device to form a toner image by supplying a toner to the electrostatic latent image formed by the image forming portion; and a toner supply device to replenish the toner to the developing device, wherein the toner supply device includes: a toner bottle containing the toner; a coupling to connect a cap portion of the toner bottle by inserting it at a specific position; and a driving unit to rotate the toner bottle to replenish the toner to a toner replenishing opening from the cap portion of the toner bottle and to rotate the coupling to the specific position when the toner bottle is pulled out at a position other than the specific position.

DETAILED DESCRIPTION OF THE INVENTION

This invention will be explained below in detail referring to embodiments shown in attached drawings.

Figure 1:
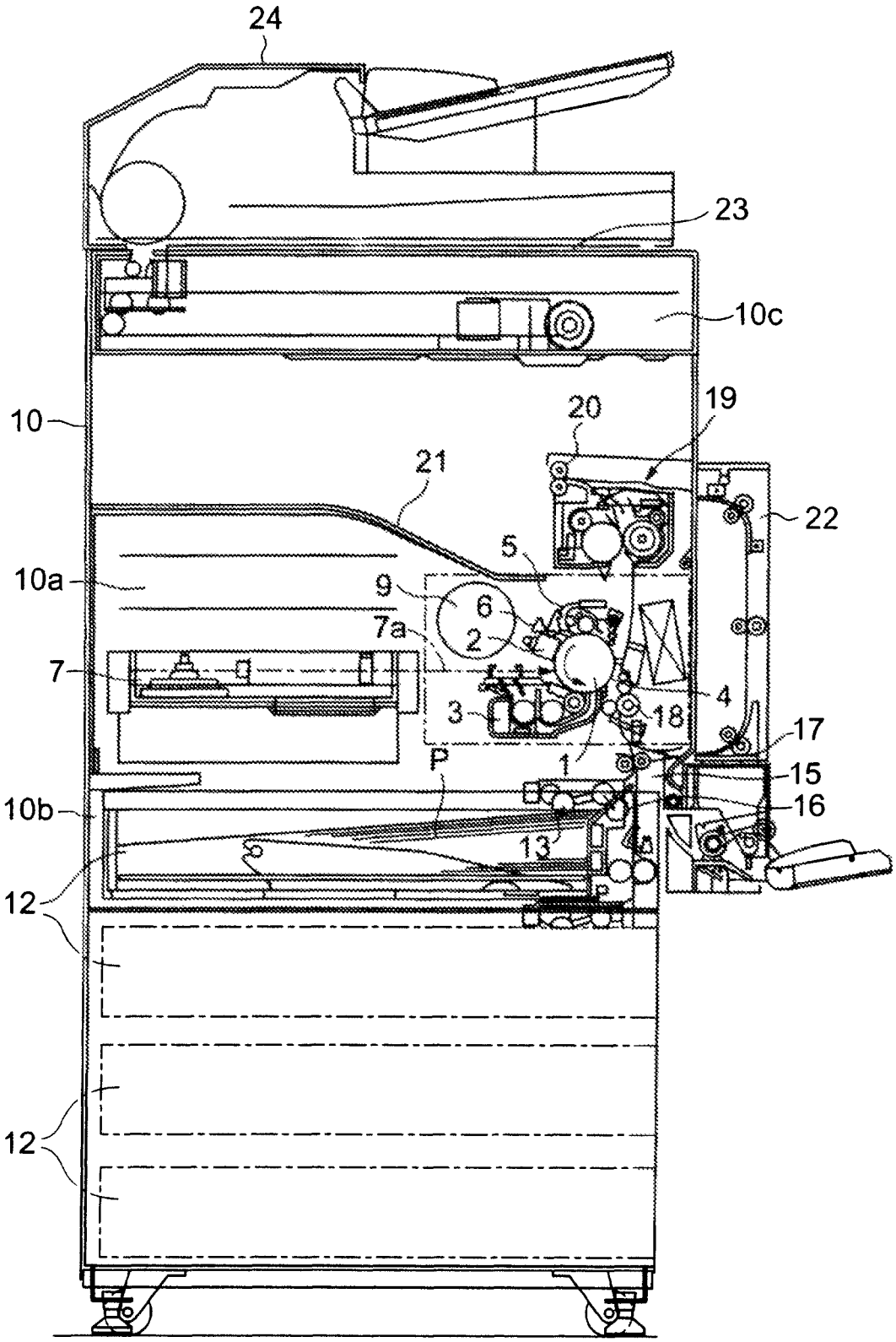
FIG. 1 is a diagram schematically showing the internal construction of an electro-photographic copier that is one embodiment of this invention.

FIG. 1 schematically shows the internal construction of an electro-photographic copier that is an image forming apparatus in one embodiment of this invention.

Reference Numeral 10 shown in FIG. 1 is a main body of a copier. An image forming portion 10*a* is provided at almost the center in the main body 10. Image forming portion 10*a* is equipped with a photosensitive drum as an image carrier that is rotatable in the arrow direction. Around a photosensitive drum 1, there are provided a main charger 2 to charge the surface of photosensitive drum 1, a developing device 3 to develop an electrostatic latent image on photosensitive drum 1 with a toner, a transfer charger 4 to transfer a toner image on photosensitive drum 1 on a paper, a cleaner 5 to remove residual toner on photosensitive drum 1, and an charge eliminator 6 to remove electric potential remained on photosensitive drum 1 in order along the rotating direction of the drum. Above developing device 3, a toner supply device 9 as a toner supply means to supply toner to developing device 3 is provided.

On photosensitive drum 1, an exposure unit 7 is provided as an image forming means to form an electrostatic latent image by applying an image data beam 7*a* to the surface of photosensitive drum 1.

At the lower side in the main body of the copier, a paper supply unit 10*b* is provided to supply paper. Paper supply unit 10*b* is provided with plural stages of paper supply cassettes 12 housing paper. Paper housed in paper supply cassettes 12 is taken out by rotating a pick-up roller 13. The taken out paper is conveyed upward by a paper conveying unit 15.

In paper conveying unit 15, paper supply/separation rollers 16 to separate and supply paper one by one, a conveying roller pair 17 to hold and convey paper, an aligning roller pair 18 to align paper, a fixing device 19 to fix a transferred toner image on paper, an exit roller pair 20 to discharge paper, and a paper receiving tray 21 to receive discharged paper are provided in order along the paper conveying direction.

At the upper side in main body 10, an image reader 10*c* is provided. A document placed on a document table glass 23 is optically read with this image reader 10*c*. On document table glass 23, a document feeding unit 24 is provided so that it can be opened/closed.

Next, the image forming operation of the above-mentioned image forming apparatus will be explained.

When forming an image, a document image on document table glass 23 is optically read with image reader 10*c* and the surface of photosensitive drum 1 is uniformly charged with main charger 2. Image data beam 7*a* is irradiated on charged photosensitive drum 1 based on the read image data from exposure unit 7 and an electrostatic latent image is formed thereon. This electrostatic latent image is sent to developing device 3 by rotating photosensitive drum 1 and is developed by a toner supplied from developing device 3. A developed toner image is moved to oppose to transfer charger 4 by rotating photosensitive drum 1.

At this time, on the other hand, paper P is supplied from paper supply cassettes 12 and fed into an image transfer portion 2*a* that is provided between photosensitive drum 1 and transfer charger 4, and a toner image formed on photosensitive drum 1 is transferred on a paper P. After transferred, the paper P is separated from photosensitive drum 1 and sent to fixing device 19. This toner image is heated in fixing device 19 and pressurized and foxed on the paper P. After the image was fixed, the paper P is discharged on paper receiving tray 21 by paper exit roller pair 20. Thereafter, the image forming operation is repeated in the same manner as described above.

Figure 2:
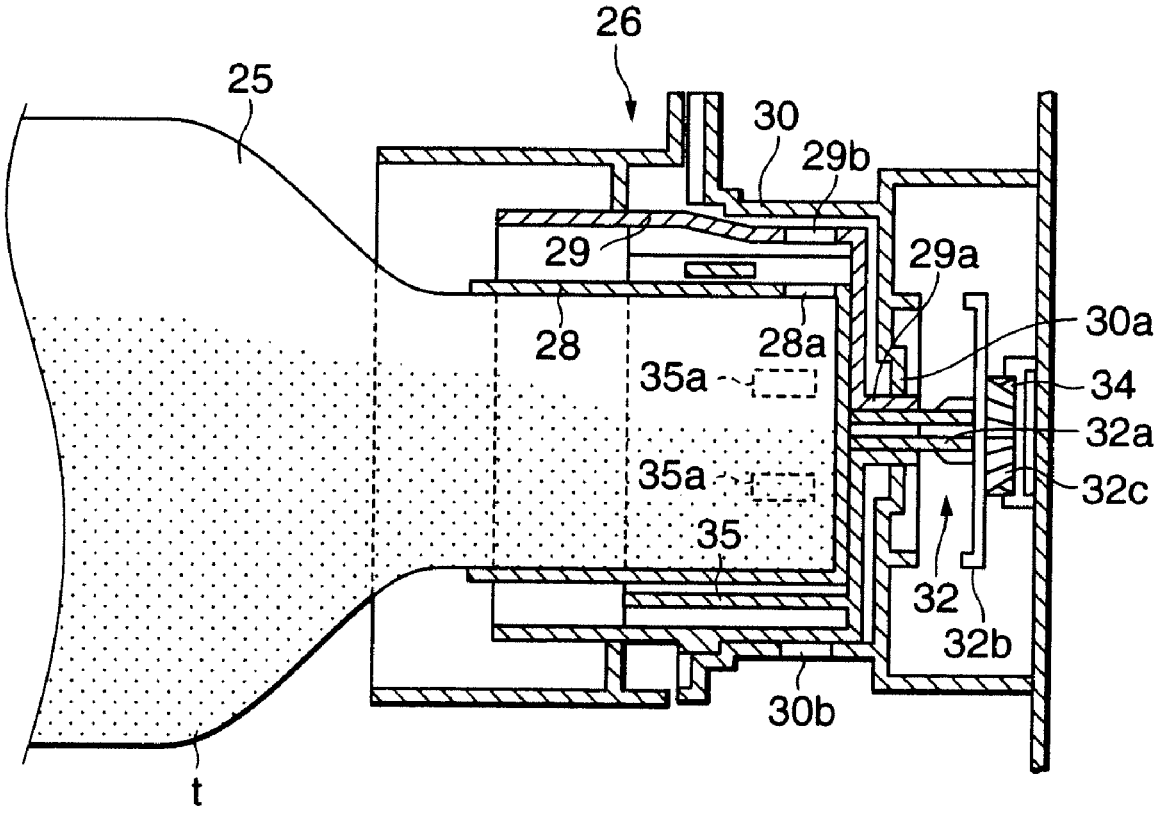
FIG. 2 is a side view showing a toner supply device provided to the electro-photographic copier shown in FIG. 1.

FIG. 2 is a side sectional view showing toner supply device 9.

The cap portion of a toner bottle 25 that is a toner container containing a toner t that is a developer is connected to a driving unit 26 and is driven to rotate.

Driving unit 26 has a cylindrical shape coupling 29 that inserts a cap portion 28 of toner bottle 25 and connects it to driving unit 26 detachably. Coupling 29 is provided rotatably in a cylindrical casing 30. At the bottom side of the peripheral wall portion of casing 30, a toner replenishing opening 30*b* is perforated.

At the center of the inner bottom of coupling 29, an outlet portion 29*a* is provided. The external wall portion of outlet portion 29*a* is in the circular shape and the inner wall is in the polygonal shape. Outlet portion 29*a* is inserted rotatably in a fixing opening 30*a* perforated on casing 30. On the peripheral wall portion of coupling 29, a toner supply opening is perforated.

When toner bottle 25 is inserted, coupling 29 is at the specific position, that is, in the state where toner supply opening 29*b* is positioned at the upper side. At this specific position, toner bottle 25 is inserted into coupling 29 and its toner supply opening 28*a* is opposed to toner supply opening 29*b*.

In outlet portion 29*a* of coupling 29, a coupling gear 32 is attached as a driven gear slidably in the inserting direction of toner bottle 25. Coupling gear 32 has a shaft 32*a* in the polygonal section and one end of shaft 32*a* is inserted into outlet portion 29*a* slidably. The other end of shaft 32*a* has a gear portion protruded via a disc shape plate 32*b*.

Gear 32*c* is meshed with a drive gear 34. A drive motor (not shown) is connected to this drive gear 34. Coupling gear 32 is pressed in the direction where gear portion 32*c* of coupling gear 32 is separated by a pressing member that will be described later, that is, in the direction to pull out toner bottle 25.

Figure 3:
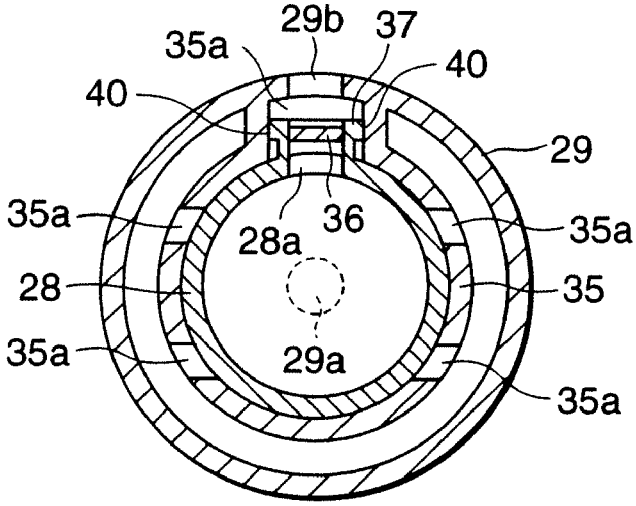
FIG. 3 is a front sectional view showing a coupling of the toner supply device shown in FIG. 2.
Figure 4:
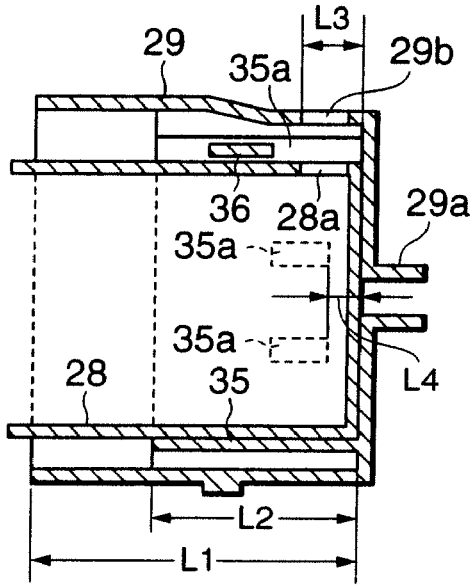
FIG. 4 is a side sectional view showing the coupling shown in FIG. 3.

FIG. 3 is a front sectional view showing coupling 29 described in the above and FIG. 4 is its side sectional view.

In the inside of coupling 29, a partition wall 35 is provided integrally with a specified space on its inner wall surface. On the peripheral wall of partition wall 35, plural holes 35*a* are drilled in the peripheral direction. A total opening amount of these plural holes 35*a* is larger than the amount of opening of toner supply opening 29*b*.

On the other hand, opening 28*a* of cap portion 28 of toner bottle 25 is opened/closed with a shutter 36. Shutter 36 is attached to a projection portion 37 in the radial direction and pressed in the direction to close opening 28*a* by a spring (not shown).

On the partition wall 35 of coupling 29, a guide portion 40 is provided to guide a projecting portion 37 of toner bottle 25 and the opening 28*a* of its cap portion 28 to face toner supply opening 29*b*.

A size L1 in the depth direction of coupling 29 is larger than a size L2 in the depth direction of partition wall 35. A size L4 to holes 35*a* is smaller than a size L3 to the opening end of coupling 29.

Next, the toner supply operation will be explained.

In the state shown in FIG. 2, when the drive motor is driven and a drive gear 34 is rotated, coupling gear 32 is rotated by gear portion 32*c*. With this rotation, coupling 29 is rotated and toner bottle 25 is rotated. With this rotation, when toner supply opening 29*b* of coupling 29 is moved to face toner supply opening 30*b* of casing 30, toner t in toner bottle 25 drops and is supplied into developing device 3 from toner replenishing opening 30*b* of casing 30 through opening 28*a* of cap portion 28 and toner supply opening 29*b* as shown by the arrow.

When toner in toner bottle 25 is exhausted as a result of supply of toner as described above, it is necessary to exchange toner bottle 25 with a new toner bottle 25.

In this case, after pulling used toner bottle 25 out of coupling 29, insert a new toner bottle 25 into coupling 29.

Figure 6:
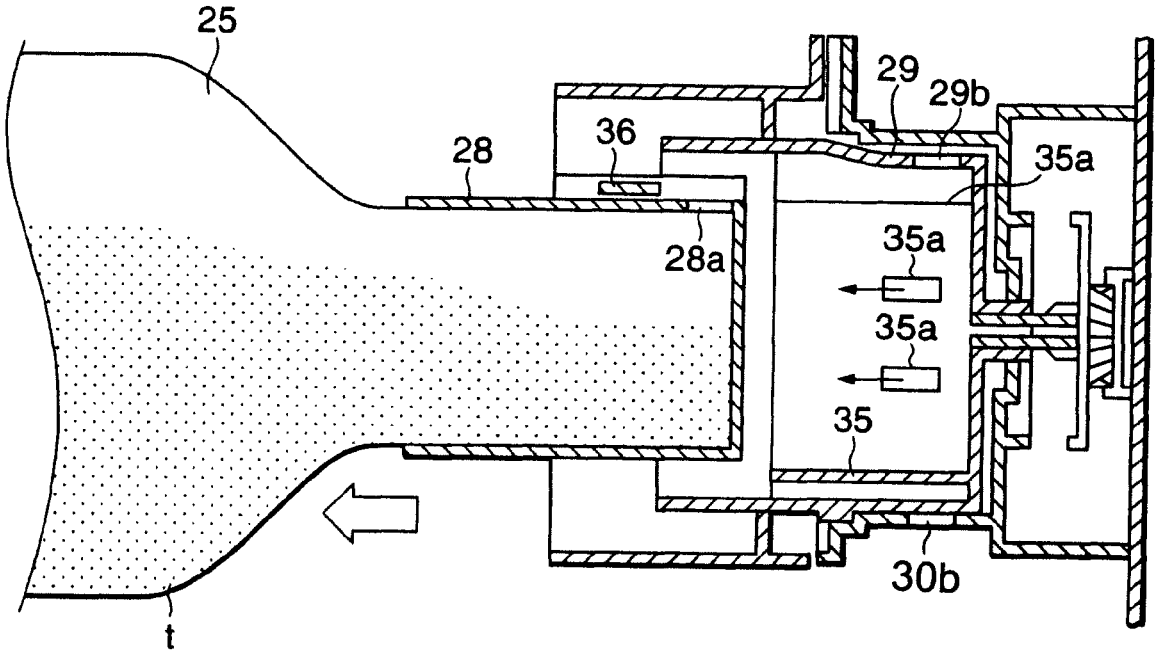
FIG. 6 is a side sectional view showing the toner bottle pull-out operation.

Because cap portion 28 of toner bottle 25 is inserted into partition wall 35 of coupling 29 and connected airtight, when toner bottle 25 is pulled out, the inside of partition wall 35 becomes the negative pressure state as shown in FIG. 6. However, the air existing between coupling 29 and partition wall 35 is sucked into the inside of partition wall 35 from holes 35*a* of partition wall 35 as shown by the arrow. By this suction, sucking force acting to toner supply opening 29*b* of coupling 29 is lowered and toner remaining on the peripheral edge of toner supply opening 29*b* will not be sucked from toner supply opening 29*b*. Therefore, it becomes possible to prevent contamination of toner in coupling 29 certainly.

Figure 7:
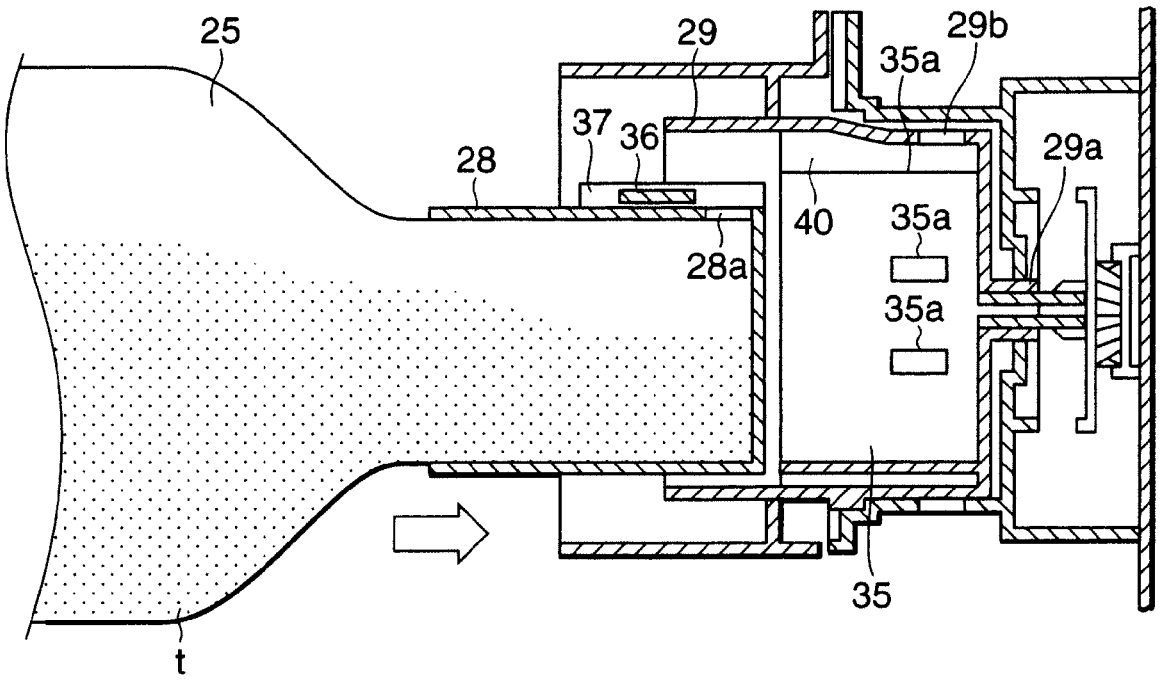
FIG. 7 is a side sectional view showing the toner bottle inserting operation into the coupling.

When inserting new toner bottle 25 into coupling 29, first insert cap portion 28 of toner bottle 25 into the front end side of partition wall 35 along the inner surface of coupling 29 as shown in FIG. 7. Then, turn toner bottle 25 in the peripheral direction on the inner surface of coupling 29 from this state and at a position where its projecting portion 37 is opposed to a guide portion 40, push toner bottle 25 inward. Thus, projecting portion 37 of cap portion 28 of toner bottle 25 is inserted into guide portion 40. When inserting toner bottle 25, a shutter 36 contacts a stopper (not shown) and is opened and opening 28*a* is faced to toner supply opening 29*b* of coupling 29 via holes 35*a* of partition. When coupling 29 is turned from this state and toner supply opening 29*b* is positioned at the lower portion side, toner in toner bottle 25 drops downward by its own weight through opening 28*a* of cap portion 28 and replenished to developing device 3.

As described above, when pulling out toner bottle 25, the air between coupling 29 and partition wall 35 is sucked into the inside through holes 35*a* of partition wall 35 and air sucking force acting on toner supply portion 29*b* of coupling 29 can be lowered and toner will not be sucked through toner supply portion 29*b*. Accordingly, it becomes possible to surely prevent contamination of toner in the coupling.

Further, when inserting new toner bottle 25 in coupling 29, after inserting toner bottle 25 along the inner surface at the front end side of coupling 29, only turn toner bottle 25. Thus, toner bottle 25 can be positioned and the inserting work of toner bottle 25 becomes easy.

Figure 8:
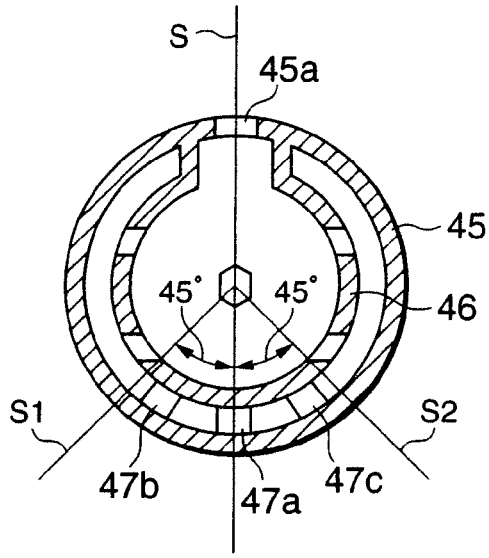
FIG. 8 is a front sectional view showing a modification of the coupling.

FIG. 8 is a sectional view showing a coupling 45 in a second embodiment of this invention.

In this second embodiment, plural ribs 47*a*, 47*b* and 47*c* are provided as supporting members by projecting in the peripheral direction between the inner surface of coupling 45 and outer surface of partition wall 46 and a partition wall 46 is supported by these plural ribs 47*a*, 47*b* and 47*c*.

Rib 47*a* is positioned at the opposite side to a toner supply opening 45*a* of coupling 45 and other ribs 47*b* and 47*c* are arranged in a range formed at an angle ±45° by a straight line S connecting toner supply opening 45*a* and rib 47*a* and straight lines S1 and S2 passing the center of coupling 45.

Ribs 47*a*, 47*b* and 47*c* are formed in a length equal to a depth L2 of a partition wall 46 so as not to projecting forward from the opening end of partition wall 46. Thus, when inserting toner bottle 25, it can be inserted smoothly without contacting ribs 47*a*, 47*b* and 47*c* by cap portion 28.

According to the second embodiment, the strength of partition wall 46 can be increased and the positional relation between toner supply opening 45 and opening 28*a* of cap portion 28 of toner bottle 25 can maintained satisfactorily.

Figure 9A:
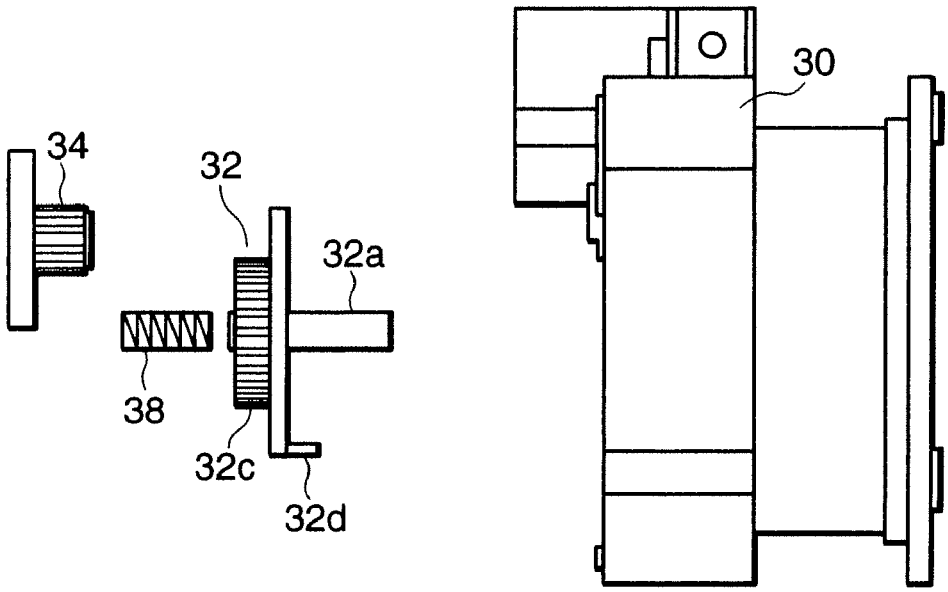
FIG. 9A is a side view showing the exploded toner supply device.
Figure 9B:
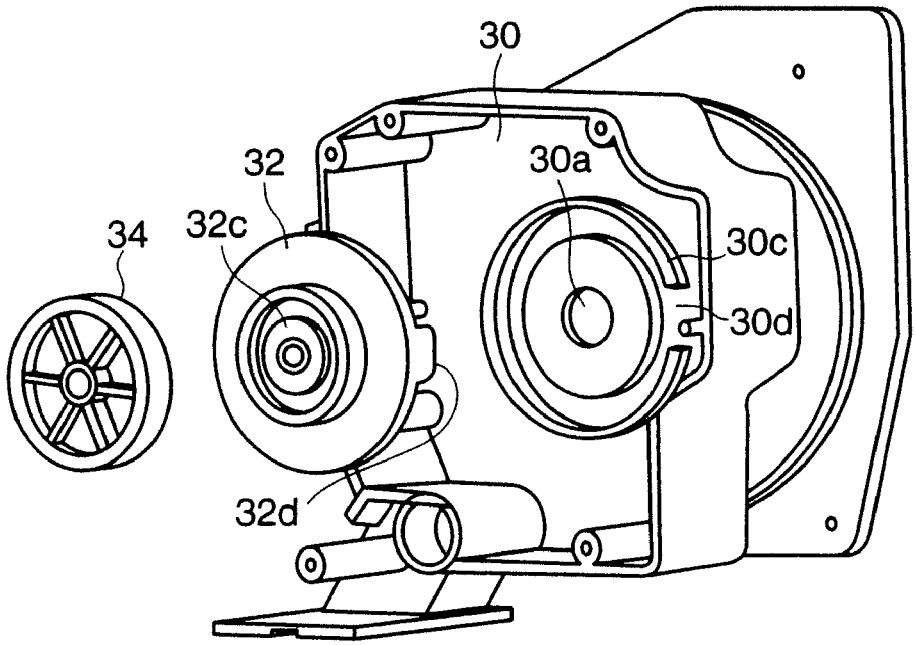
FIG. 9B is a perspective view of the exploded toner supply device.

Next, a third embodiment of this invention will be explained. FIG. 9A is a side view showing exploded casing 30, coupling gear 32 and drive gear 34, and FIG. 9B is its exploded perspective view.

On casing 30, a circular shape rib 30*c* is provided by projecting to enclose the periphery portion of fixing opening 30*a* and a concave portion 30*a* is formed on this rib 30*c*. On coupling gear 32, a protrusion 32*d* is formed projecting toward the front surface of a rib 30*c*.

When toner bottle 25 is inserted and its edge face pushes shaft 32*a*, coupling gear 32 moves against the pressing force of pressing member 38 composed of a coil spring and mesh its gear portion 32*c* with drive gear 34.

When toner bottle 25 is pulled out, coupling gear 32 is moved in the toner bolt pulling out direction by the compression force of compression member 38 and brings protrusion 32*d* to contact the front end of rib 30*c* of casing 30. At the time of this contact, gear portion 32*c* of coupling gear 32 shifts from drive gear 34 by its moving amount but the meshed state is maintained.

When protrusion 32*d* of coupling gear 32 is kept in contact with the front end of rib 30*c* of casing 30 and coupling gear 32 is rotated and its protrusion 32*d* falls in concave portion 30*d* of rib 30*c* of casing 30, gear portion 32*c* of coupling gear 32 is completely separated from drive gear 34 and the meshed state is cancelled.

Next the toner replenishing operation will be explained.

Figure 5:
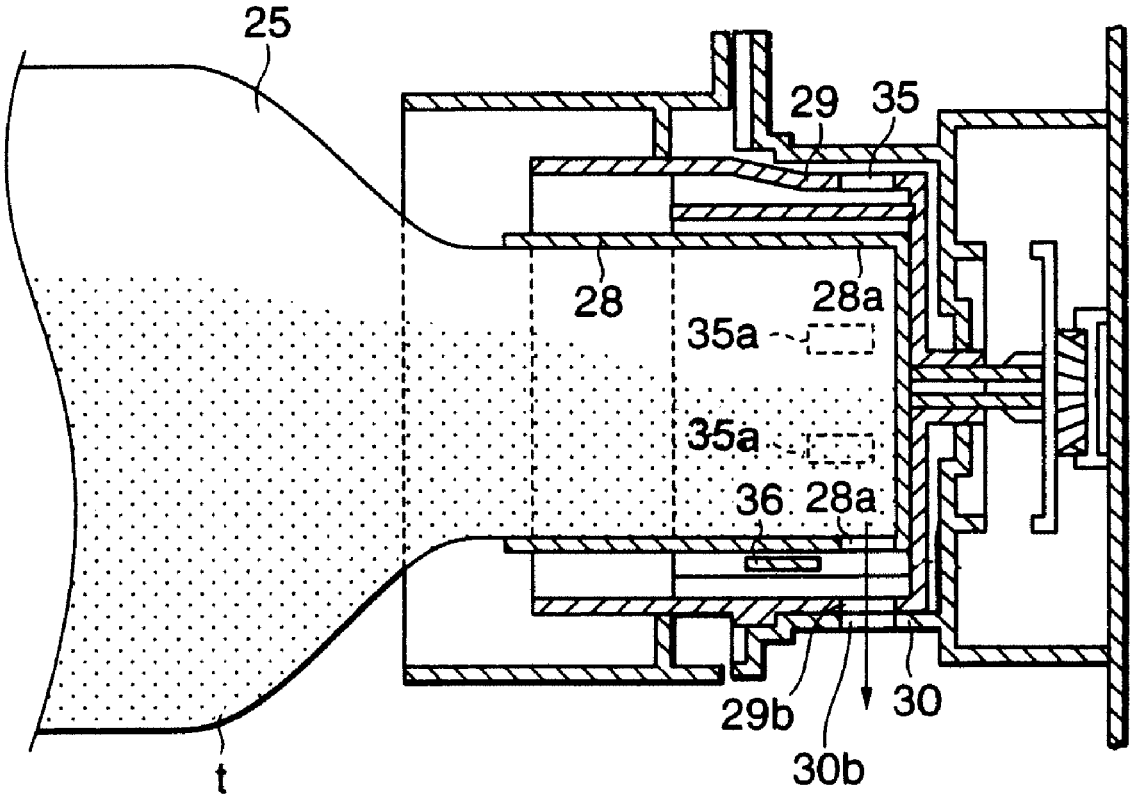
FIG. 5 is a side sectional view showing the state of toner supplied by the toner supply device.

When the drive motor is driven and drive gear 34 is driven to rotate, coupling gear 32 is turned by gear portion 32*c* and coupling 29 is rotated and then, toner bottle 25 is rotated. As a result, opening 28*a* of cap portion 28 of toner bottle 25 and toner supply opening 29*b* of coupling 29 are opposed to toner replenishing opening 30*b* of casing 30 as shown in FIG. 5. Then, toner t in toner bottle 25 drops from toner replenishing opening 30*b* through opening 28*a* and toner supply opening 29*b* and supplied in developing device 3 as shown by the arrow.

Figure 10:
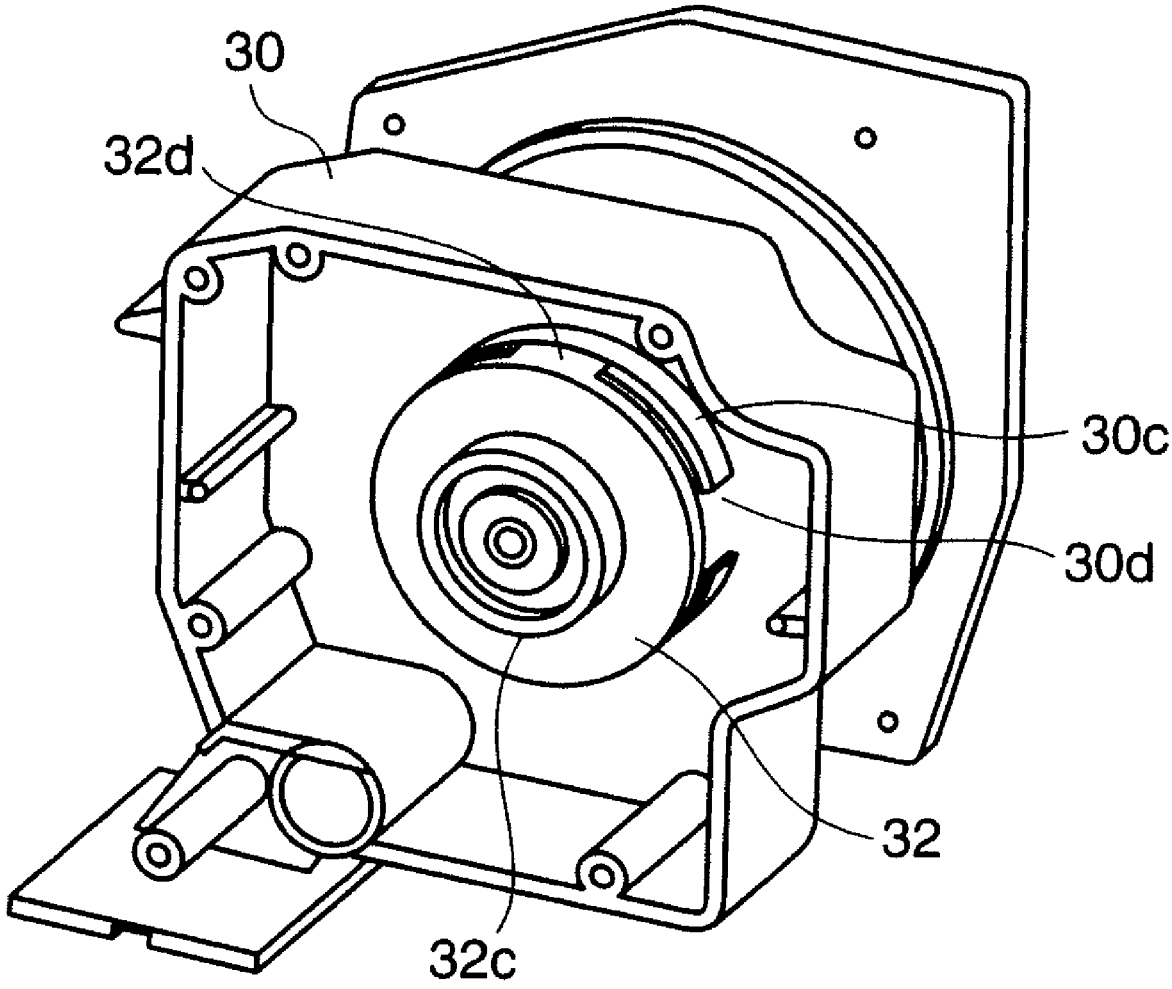
FIG. 10 is a perspective view showing a protrusion of the coupling in the state contacted to the rib of the coupling gear when a toner bottle of the toner supply device was pulled out.
Figure 11:
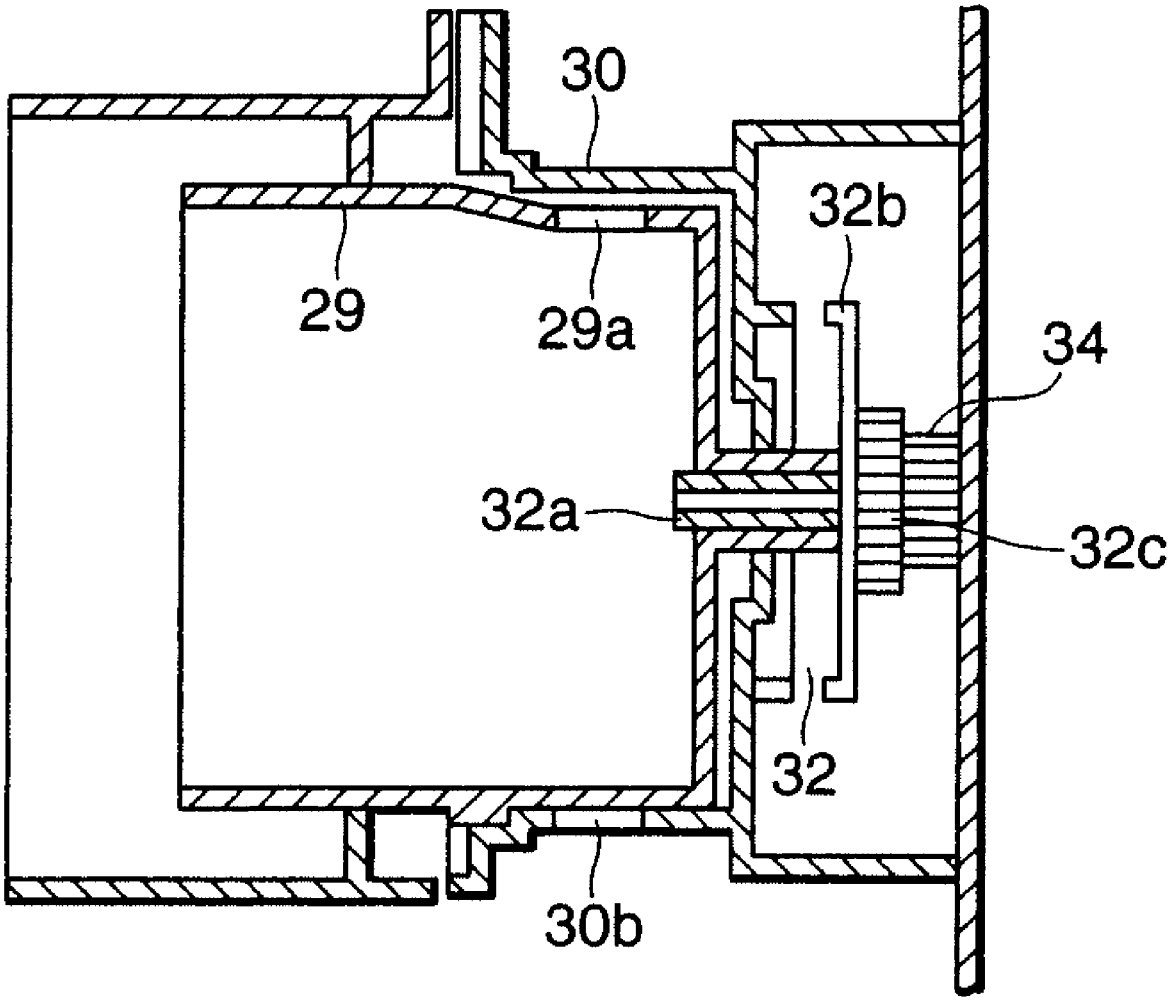
FIG. 11 is a side view showing the state of the coupling to rotate when the drive gear is rotated from the state shown in FIG. 10.

In the image forming operation described above, when a certain defect was caused, toner bottle 25 would be stopped to rotate and bottle 25 would be pulled out irrespective of its position when bottle 25 was stopped to rotate. At this time, coupling gear 32 moves in the direction to pull out toner bottle 25 by the pressing force of a pressing member 38 and brings protrusion 32*d* to contact the front end of rib 30*c* as shown in FIG. 10. By this contact, gear portion 32*c* of coupling gear 32 and drive gear 34 are kept in the meshed state. When the power source is turned ON in this state, drive gear 34 is rotated and gear portion 32*c* of coupling gear 32 is rotated. As a result of this rotation, coupling 29 is rotated and with this rotation, protrusion 32*d* of coupling gear 32 slides along the front edge surface of rib 30*c* of casing 30.

Figure 12:
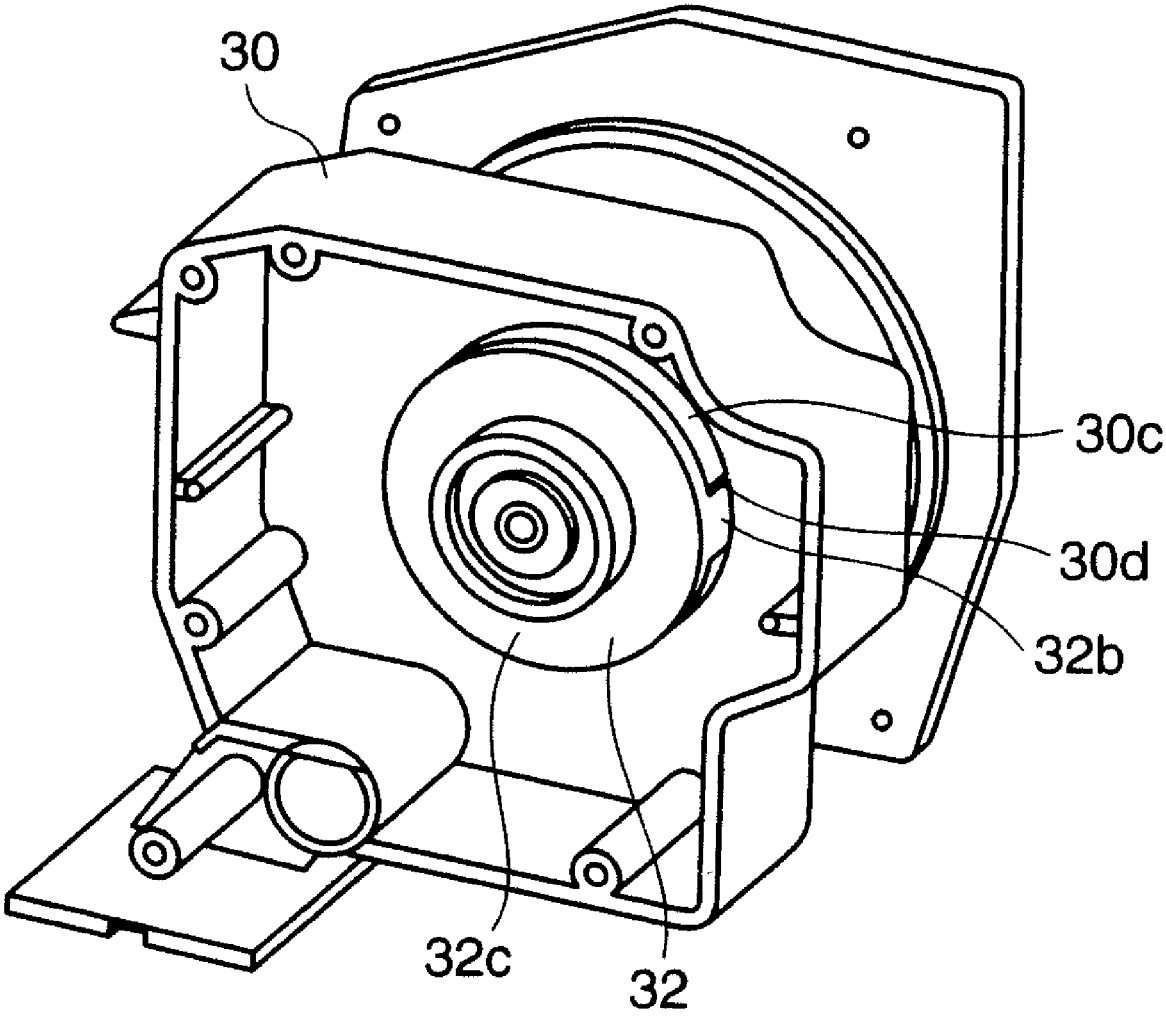
FIG. 12 is a perspective view showing the state when the coupling gear was rotated in a certain amount and the protrusion was intruded into the concave portion.
Figure 13:
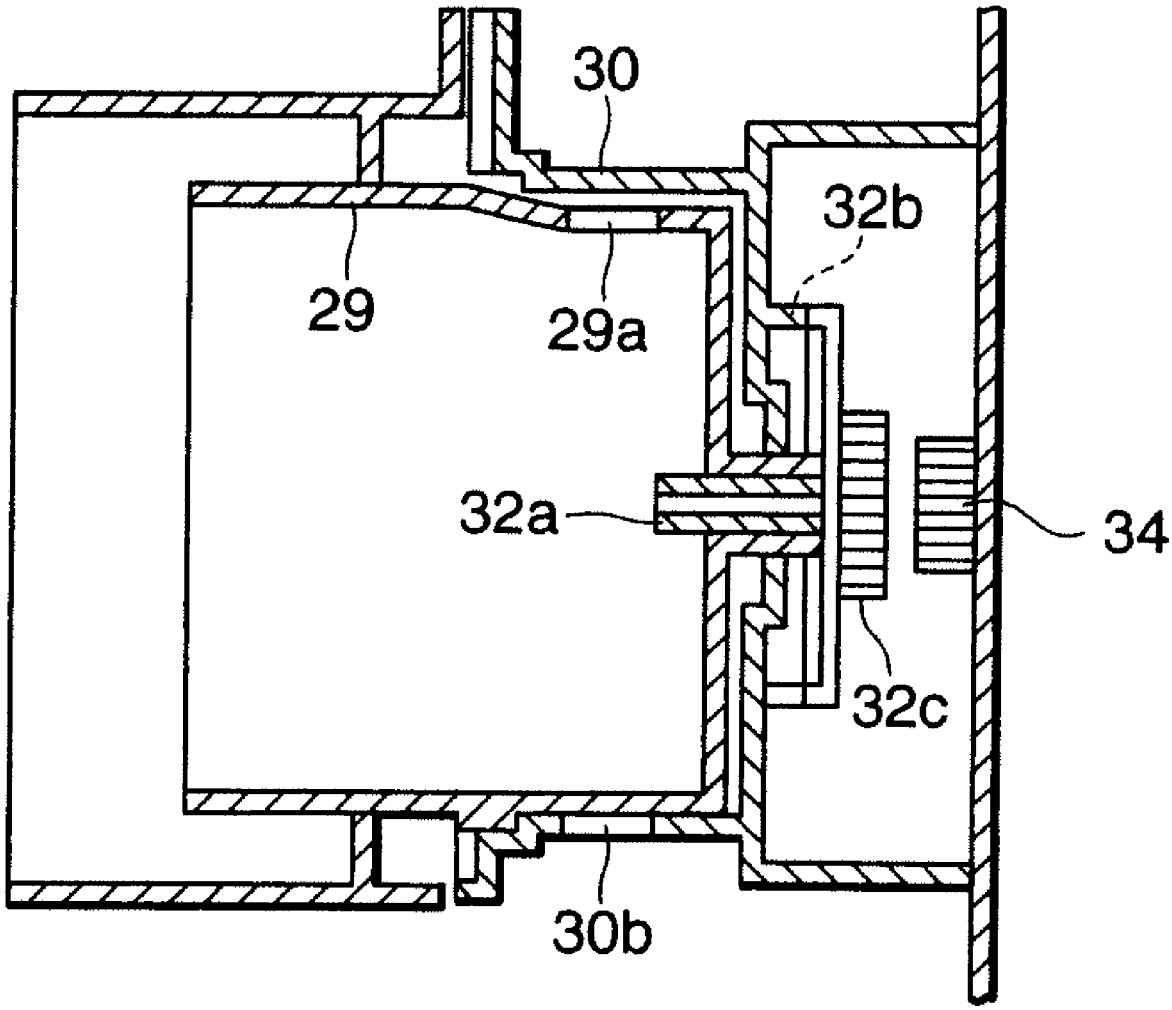
FIG. 13 is a side sectional view showing the state when the coupling ear was completely disengaged from the drive gear.

When drive gear 34 is rotated for a specified amount (below one turn), protrusion 32*d* of coupling gear 32 falls into concave portion 30*d* of rib 30*c* of casing 30 as shown in FIG. 12. As a result, gear portion 32*c* of coupling gear 32 is completely separated from drive gear 34 and the meshed sate is cancelled and coupling 29 is stopped at a specific position as shown in FIG. 13.

Figure 14:
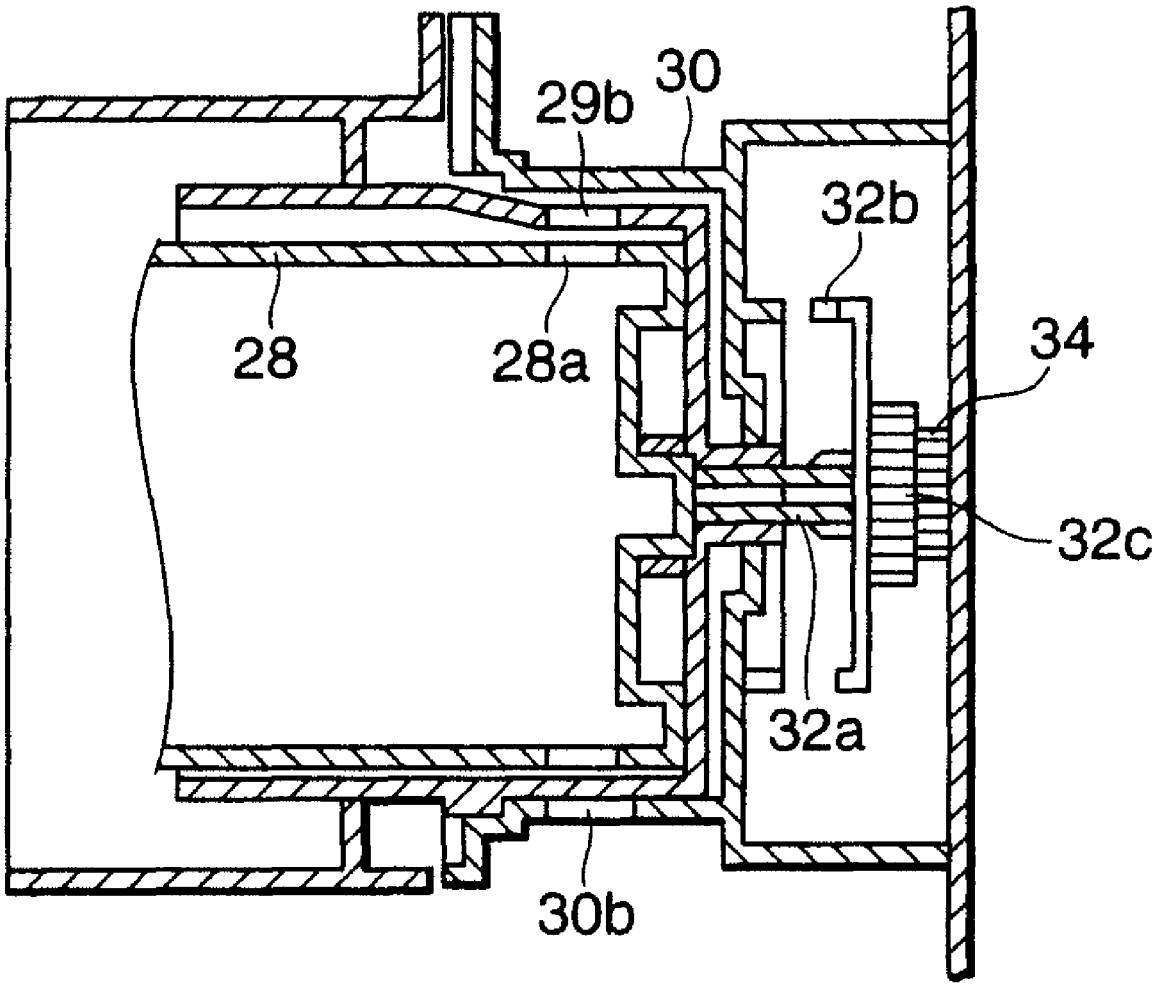
FIG. 14 is a side view showing the state when a toner bottle was inserted in the coupling.

After coupling 29 is stopped at the specific position, insert cap portion 28 of toner bottle 25 into coupling 29 and connect it to coupling 29 as shown in FIG. 14. Further, coupling gear 32 is pushed in against the pressing force of pressing member 38 and it becomes possible to transmit power by engaging gear portion 32*c* with drive gear 34.

After toner bottle 25 is pulled out from coupling 29 at a position other than the specific position, coupling 29 is rotated to the specific position as described above. Therefore, the positioning of toner bottle 25 to coupling 29 becomes easy and it becomes smooth to insert toner bottle 25 into coupling 29.

Further, this invention is not restricted to the embodiments described above but needless to say, it is possible to modify it variously within its scope.

As explained above, this invention displays such effects that it is able to lower the sucking force acting on the toner supply opening of the coupling, reduce the suction of toner from the toner supply opening to the extent possible and prevent contamination of the coupling.

Further, in this invention, when a toner bottle is pulled out from the coupling at a position other than the specific position, the coupling is rotated to the specific position and therefore, it becomes easy to position a toner bottle to the coupling and smoothly insert a toner bottle.

When a toner bottle was not inserted into the coupling, the coupling is disconnected from the driving unit and therefore, the coupling will not be rotated and toner does not flow back from the toner supply opening of the coupling and is not dispersed by the centrifugal force.

What is claimed is:

1. A toner bottle detachably mounted in an image forming apparatus including an image forming portion to form an electrostatic latent image on an image carrier, a developing device to form a toner image by supplying a toner to the electrostatic latent image formed by the image forming portion and a toner supply device having a coupling that has a toner supply opening on a peripheral wall portion and a hole on its peripheral wall larger than the toner supply opening on the peripheral wall portion, the toner bottle comprising:

a bottle shaped main body having a cap portion inserted into the partition wall; and a toner replenishing opening on a peripheral wall of the cap portion, opposite to the hole, the toner bottle supplying toner to a toner supply portion through the hole and the toner supply opening from the bottle shaped main body, wherein the air existing between the coupling and the partition wall is sucked inside the partition wall from the hole when the toner bottle is pulled out from the partition wall.

2. The toner bottle according to claim 1, wherein plural holes are provided in a peripheral direction of the inner wall surface of the coupling.

3. The toner bottle according to claim 1, wherein the toner bottle has a projecting portion projecting in a radial direction of its peripheral wall, and the partition wall has a guide portion to slide the projecting portion to oppose the toner replenishing opening to the toner supply opening.

4. The toner bottle according to claim 1, wherein an opening of the partition wall is positioned inside more than an opening of the coupling, the toner bottle is inserted in front of the partition wall along an inner surface of the coupling and is then rotated along a peripheral direction of the coupling and positioned.

5. The toner bottle according to claim 1, wherein a supporting member is provided to support the partition wall at a position opposite to the toner supply opening between an inner wall surface of the coupling and an outer wall surface of the partition wall.

6. A toner bottle detachably mounted in an image forming apparatus including an image forming portion to form an electrostatic latent image on an image carrier, a developing device to form a toner image by supplying a toner to the electrostatic latent image formed by the image forming portion, and a toner supply device having a coupling to insert a cap portion side of the toner bottle at a specific position and connect the toner bottle in a removable state; a driving unit to rotate the coupling and replenish the toner to the developing device requiring the replenishing of toner from the cap portion by rotating the toner bottle and rotating the coupling to the specific position when the toner bottle is pulled out at a position other than the specific position, a driven gear connected to the coupling slidably in a toner bottle insert/pull-out direction through a rotary shaft penetrating a casing; a pressing member to press the driven gear in the pull-out direction of the toner bottle; a driving gear that is engaged with the driven gear to turn the coupling; and a protrusion formed on a part of the driven gear to project toward the casing with a circular shape rib projecting to oppose the protrusion of the driven gear and a concave portion is formed on a part of the rib, when the toner bottle is pulled out, by moving the driven gear with the pressing force of the pressing member, the protrusion is brought on the rib to keep the driven gear meshed with the driving gear, from this state, the protrusion is slid on the rib into the concave portion by rotating the driven gear with the rotation of the driving gear, thus, the meshing of the driven gear with the driving gear is released to stop the rotation of the coupling, the toner bottle comprising:

a bottle shaped main body having a cap portion inserted into the partition wall; and a toner replenishing opening on a peripheral wall of the cap portion, opposite to the hole, the toner bottle supplying toner to a toner supply portion through the hole and the toner supply opening from the bottle shaped main body, wherein the air existing between the coupling and the partition wall is sucked inside the partition wall from the hole when the toner bottle is pulled out from the partition wall.

7. The toner bottle according to claim 6, wherein plural holes are provided in a peripheral direction of the inner wall surface of the coupling.

8. The toner bottle according to claim 6, wherein the toner bottle has a projecting portion projecting in a radial direction of its peripheral wall, and the partition wall has a guide portion to slide the projecting portion to oppose the toner replenishing opening to the toner supply opening.

9. The toner bottle according to claim 6, wherein an opening of the partition wall is positioned inside more than an opening of the coupling, the toner bottle is inserted in front of the partition wall along an inner surface of the coupling and is then rotated along a peripheral direction of the coupling and positioned.

10. The toner bottle according to claim 6, wherein a supporting member is provided to support the partition wall at a position opposite to the toner supply opening between an inner wall surface of the coupling and an outer wall surface of the partition wall.

* * * * *